US008928535B2

(12) United States Patent
Wu et al.

(10) Patent No.: US 8,928,535 B2
(45) Date of Patent: Jan. 6, 2015

(54) ELECTRONIC APPARATUS

(75) Inventors: Chang-Hsun Wu, Taipei (TW); Chien-Yi Wu, Taipei (TW)

(73) Assignee: Pegatron Corporation, Taipei (TW)

( * ) Notice: Subject to any disclaimer, the term of this patent is extended or adjusted under 35 U.S.C. 154(b) by 448 days.

(21) Appl. No.: 13/350,593

(22) Filed: Jan. 13, 2012

(65) Prior Publication Data

US 2012/0182189 A1 Jul. 19, 2012

(30) Foreign Application Priority Data

Jan. 14, 2011 (TW) ..... 100101475 A

(51) Int. Cl.
*H01Q 1/24* (2006.01)
*H01Q 3/24* (2006.01)

(52) U.S. Cl.
CPC . *H01Q 3/24* (2013.01); *H01Q 1/243* (2013.01)
USPC ..... 343/702; 343/876

(58) Field of Classification Search
CPC ..... H01Q 1/243; H01Q 3/24
USPC ..... 343/702, 876
See application file for complete search history.

(56) References Cited

U.S. PATENT DOCUMENTS 4,897,644 A * 1/1990 Hirano ..... 340/5.62
7,444,175 B2 * 10/2008 Ito et al. ..... 455/575.3
7,486,975 B2 * 2/2009 Mori ..... 455/575.7
7,586,447 B2 9/2009 Kanazawa
7,800,553 B2 * 9/2010 Konaka ..... 343/876
7,847,741 B2 * 12/2010 Hirota ..... 343/702
8,432,320 B2 * 4/2013 Jagielski et al. ..... 343/702
2009/0160784 A1 6/2009 Ishida
2009/0196371 A1 8/2009 Yamamoto

FOREIGN PATENT DOCUMENTS

CN 1211114 3/1999
CN 1889590 A 1/2007
CN 101527582 A 9/2009

* cited by examiner

*Primary Examiner* — Tho G Phan
(74) *Attorney, Agent, or Firm* — Muncy, Geissler, Olds & Lowe, P.C.

(57) ABSTRACT

An electronic apparatus includes a casing, at least an antenna body, a feeding point and a control unit. The casing has a display portion. The antenna body is disposed at the casing and at least has two radiation paths and a switching element. Parts of the radiation paths are respectively disposed at two sides of the display portion. The switching element is electrically connected with the radiation paths. The feeding point is electrically connected with the switching element and operationally connected to one of the radiation paths. The control unit controls the switching element based on the rotation of the electronic apparatus. When one of the radiation paths is located between a user and the display portion, the control unit controls to selectively switch the switching element for connecting the other radiation path to the feeding point.

6 Claims, 8 Drawing Sheets

ELECTRONIC APPARATUS

CROSS REFERENCE TO RELATED APPLICATIONS

This Non-provisional application claims priority under 35 U.S.C. §119(a) on Patent Application No(s). 100101475 filed in Taiwan, Republic of China on Jan. 14, 2011, the entire contents of which are hereby incorporated by reference.

BACKGROUND

1. Technical Field

The present invention relates to an electronic apparatus and, in particular, to an electronic apparatus with the function of changing the radiation path.

2. Related Art

In order to protect the consumers, it is requested to print the caution for warning the possible harm caused by electromagnetic waves and the SAR (Specific Absorption Rate) on the electronic apparatus (e.g. mobile phone or tablet computer) that can emit electromagnetic waves, thereby decreasing the possible harm to human body. SAR represents the absorbed energy from the electromagnetic waves per unit mass within per unit time period. In other words, if the SAR is higher, the possible harm to the human body becomes more serious.

The current electronic apparatus usually has a screen rotation function that allows the screen image thereof to rotate to accommodate the new position when the user rotates the device. For example, if the electronic apparatus is rotated for 90 degrees in clockwise (or counterclockwise), the screen image can automatically rotate 90 degrees, so that the user can still view the regular screen image and operate the electronic apparatus normally. Since the antenna is configured inside the electronic apparatus, it is desired to reduce the SAR and avoid the body effect to affect the signal transceiving of the electronic apparatus. One solution for the above problem is to configure a proximity sensor for detecting the distance between the electronic apparatus and the human body and determine whether to shut down the function of the electronic apparatus while the user rotates it. Another solution is to reduce the emission power for reduce the possible harm of human body caused by higher SAR.

However, in the above-mentioned first solution, the proximity sensor may misjudge the distance between the electronic apparatus and the human body. If the proximity sensor misjudges that this distance is too short, the user may not operate the electronic apparatus normally and must rotate it back. In the above-mentioned second solution, the reduced emission power may lead to the undesired communication interruption.

SUMMARY

One embodiment of An electronic apparatus disclosed here includes a casing, at least an antenna body, a feeding point and a control unit. The casing has a display portion. The antenna body is disposed at the casing and at least has two radiation paths and a switching element. Parts of the radiation paths are respectively disposed at two sides of the display portion. The switching element is electrically connected with the radiation paths. The feeding point is electrically connected with the switching element and operationally connected to one of the radiation paths. The control unit controls the switching element based on the rotation of the electronic apparatus. When one of the radiation paths is located between a user and the display portion, the control unit controls to selectively switch the switching element for connecting the other radiation path to the feeding point.

In one embodiment, the radiation paths are disposed at two adjacent sides or two opposite sides of the electronic apparatus respectively.

In one embodiment, the electronic apparatus further includes an orientation sensor for sensing the rotation of the electronic apparatus and outputting a control signal to the control unit for controlling the switch element.

In one embodiment, the electronic apparatus performs communication through WWAN (Wireless Wide Area Network), LTE (Long Term Evolution), or WIMAX (Worldwide Interoperability for Microwave Access).

In one embodiment, when the electronic apparatus includes two antenna bodies, the antenna bodies are disposed at the left and right sides of the electronic apparatus respectively.

These and other features, aspects and advantages of the present invention will become better understood with regard to the following description, appended claims, and accompanying drawings.

DETAILED DESCRIPTION

The present invention will be apparent from the following detailed description, which proceeds with reference to the accompanying drawings, wherein the same references relate to the same elements.

Figure 1A:
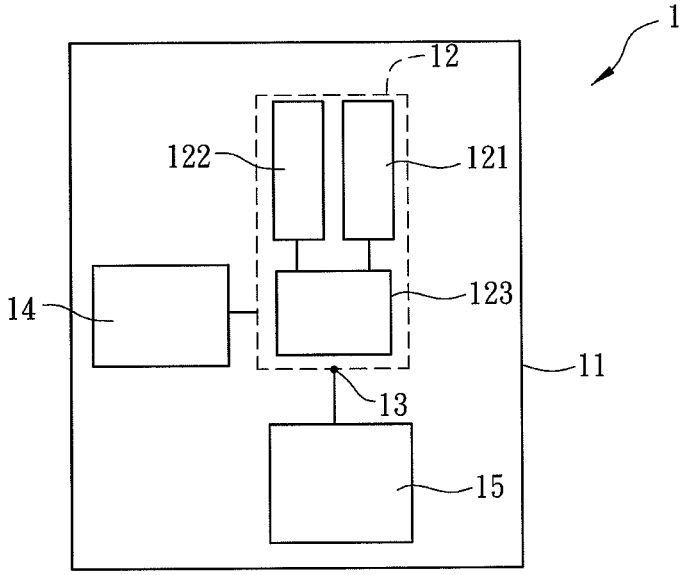
FIG. 1A is a block diagram of an electronic apparatus according to a preferred embodiment of the present invention.
Figure 1B:
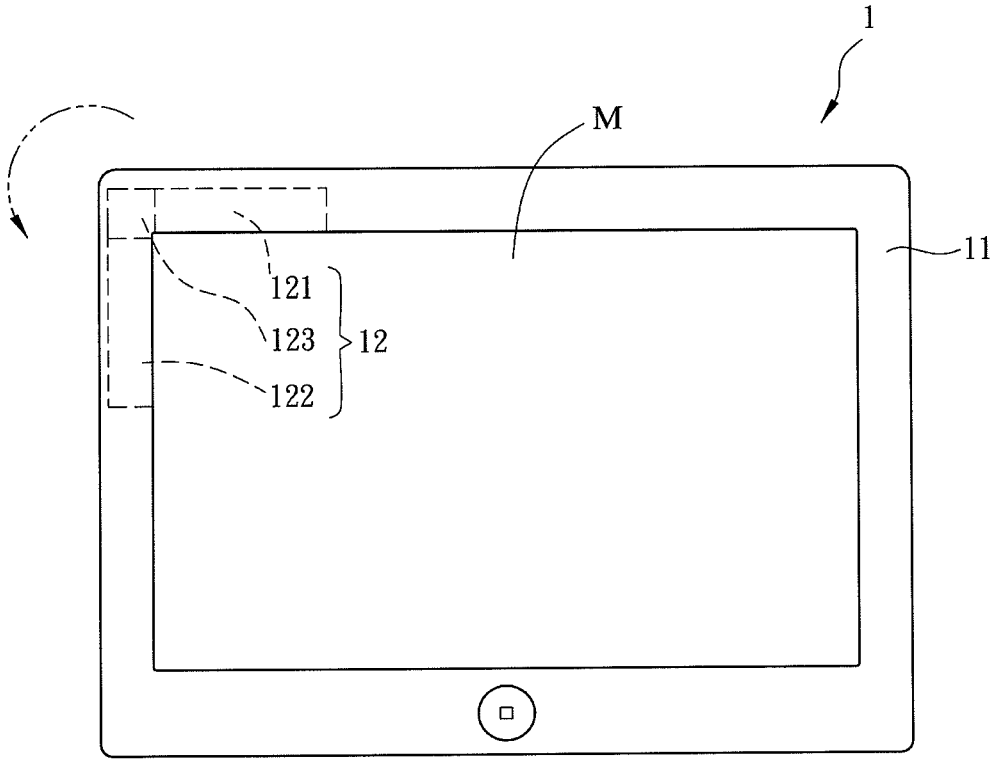
FIG. 1B and FIG. 1C are top views of the electronic apparatus according to the preferred embodiment of the present invention.
Figure 1C:
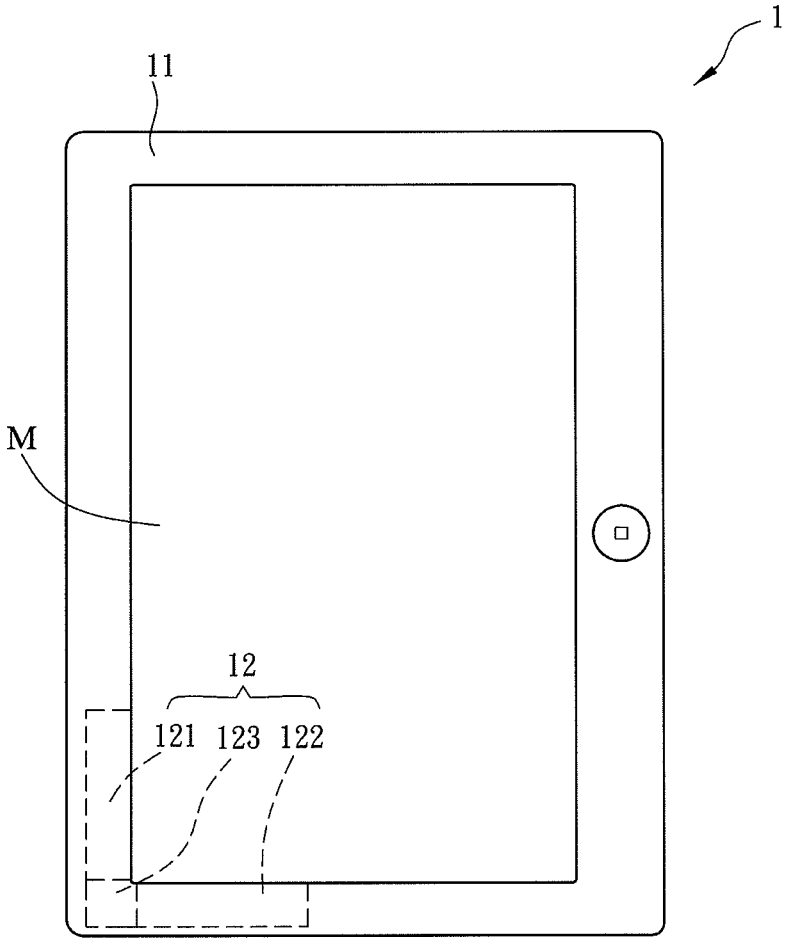

FIG. 1A is a block diagram of an electronic apparatus 1 according to a preferred embodiment of the present invention, and FIG. 1B and FIG. 1C are top views of the electronic apparatus 1 according to the preferred embodiment of the present invention.

Referring to FIGS. 1A to 1C, the electronic apparatus 1 includes a casing 11, at least an antenna body 12, a feeding point 13, and a control unit 14. The antenna body 12, the feeding point 13 and the control unit 14 are all disposed in the casing 11. The electronic apparatus 1 can be a touch-control mobile phone, a GPS, or a touch-control computer such as a tablet computer, a laptop computer or a netbook computer. In this embodiment, the electronic apparatus 1 is, for example but not limited to, a tablet computer. Besides, the electronic apparatus 1 performs communication through WWAN (Wireless Wide Area Network), LTE (Long Term Evolution), or WIMAX (Worldwide Interoperability for Microwave Access).

The casing 11 has a display portion M, and at least a part of the display portion M is exposed from the casing 11.

The antenna body 12 has at least two radiation paths 121 and 122, and a switching element 123. In this embodiment, the antenna body 12 is disposed inside the frame of the casing 11 and located adjacent to the display portion M as shown in FIG. 1B.

parts of the radiation paths 121 and 122 are respectively disposed at two sides of the display portion M. In this case, the radiation paths 121 and 122 are disposed at the adjacent sides or opposite sides of the electronic apparatus 1. In addition, the switching element 123 is disposed adjacent to one of the radiation paths 121 and 122, and it can be located at the same side as or different side from the radiation paths 121 and 122. In this embodiment, the electronic apparatus 1 is turned sideways, and the radiation paths 121 and 122 are located at two adjacent sides of the electronic apparatus 1 (e.g. the upper side and left side at the upper left corner), while the switching element 123 is connected to and located between the radiation paths 121 and 122. Of course, in other aspects, the relative positions of the radiation paths 121 and 122, and the switching element 123 in the electronic apparatus 1 can be changed. To be noted, the radiation paths 121 and 122 and the switching element 123 of the antenna body 12 in this embodiment are integratedly formed. The switching element 123 is electrically connected with the radiation paths 121 and 122, so that it can also separate the radiation paths 121 and 122 apart. The feeding point 13 is electrically connected with the switching element 123 and operationally connected to one of the radiation paths 121 and 122. In other words, the feeding point 13 can be operationally controlled to electrically connect to only one of the radiation paths 121 and 122.

The control unit 14 is electrically connected to the antenna body 12. In this case, the control unit 14 controls the switching element 123 based on the rotation of the electronic apparatus 1. When the electronic apparatus 1 is rotated to allow one of the radiation paths 121 and 122 to be located between the user and the display portion M, the control unit 14 controls to selectively switch the switching element 123 for connecting the other radiation path 121/122 to the feeding point 13. The rotation of the electronic apparatus 1 is to rotate the entire electronic apparatus 1 or to rotate the screen of the electronic apparatus 1 only. In this embodiment, the rotation of the electronic apparatus 1 means to rotate the entire electronic apparatus 1. The control unit 14 can control the switching element 123 based on an orientation sensor (not shown) of the electronic apparatus 1. In this case, the orientation sensor is, for example, a G-sensor, a gyro meter, an accelerometer, an angular velocity sensor, or an angle sensor. In other words, when the display portion M of the electronic apparatus 1 is rotated, the orientation sensor of the electronic apparatus 1 can sense the orientation change of the electronic apparatus 1 and then output a control signal to the control unit 14 to control the switching element 123, thereby selectively switching the switching element 123 to connect the other one of the radiation paths 121/122 to the feeding point 13.

In addition, the electronic apparatus 1 further includes a transmission unit 15, which is disposed in the casing 11 and connected to one of the radiation paths 121 and 122 via the switching element 123. The signal outputted by the transmission unit 15 can be inputted to the switching element 123 through the feeding point 13. Accordingly, the transmission unit 15 of the electronic apparatus 1 can emit the electromagnetic wave through one of the radiation paths 121 and 122.

In this embodiment, when the electronic apparatus 1 is rotated counterclockwise for 90 degrees (see FIG. 1C), the radiation path 122 is located between the user and the display portion M. In order to prevent the possible harm of human body caused by higher SAR when the electronic apparatus 1 is rotated, and to avoid the human-body interference of the wireless transmission of the electronic apparatus 1, the control unit 14 controls the switching element 123 to selectively switch the radiation path 121 to connect with the feeding point 13. Thus, the transmission unit 15 can emit signals through the radiation path 121.

As shown in FIG. 1B, the electronic apparatus 1 is in sideways (landscape mode), so that the radiation paths 121 and 122 are not located between the user and the display portion M. If the electronic apparatus 1 is rotated counterclockwise for 90 degrees, it is in vertical (portrait mode) as shown in FIG. 1C. Consequently, the radiation paths 121 and 122 are now located between the user and the display portion M. If the signals are still transmitted through the radiation path 122, the SAR may be too high that can cause the human-body interference. In order to reduce the SAR and the human-body interference, the control unit 14 can control the switching element 123 based on the signal outputted from the orientation sensor, so that the feeding point 13 can be switched to electrically connect the radiation path 121. Then, the signals of the transmission unit 15 are now transmitted through the radiation path 121. This configuration can prevent the excess SAR after the electronic apparatus 1 is rotated, and avoid the possible harm of human body caused by the electromagnetic waves. Moreover, the wireless transmission performance of the electronic apparatus 1 can not be affect by the human-body interference.

FIGS. 2A to 2D are top views showing different aspects of the electronic apparatus according to the preferred embodiment of the present invention.

Figure 2A:
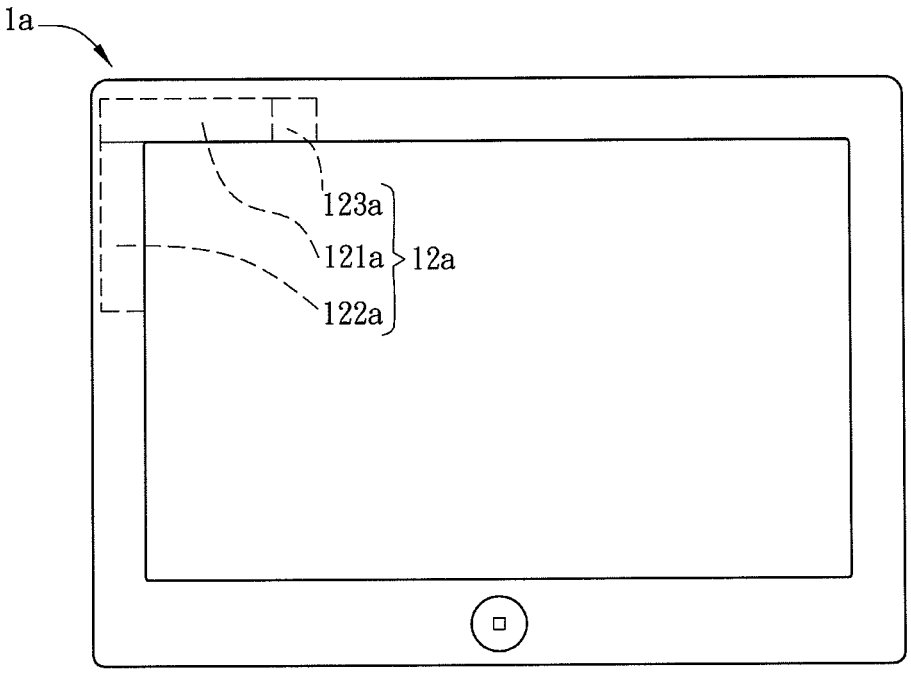
FIGS. 2A to 2D are top views showing different aspects of the electronic apparatus according to the preferred embodiment of the present invention.

Referring to FIG. 2A, the radiation paths 121*a* and 122*a* of the antenna body 12*a* are disposed at two adjacent sides of the electronic apparatus 1*a* (e.g. the upper side and left side at the upper left corner), while the switching element 123*a* is located at the right side of the radiation path 121*a*.

Figure 2B:
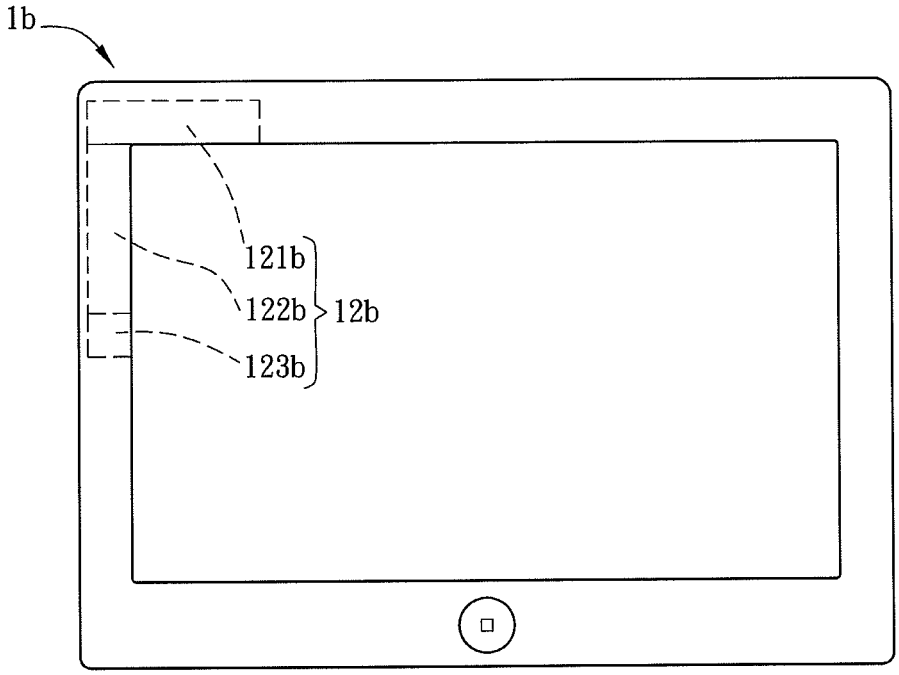

Referring to FIG. 2B, the radiation paths 121*b* and 122*b* of the antenna body 12*b* are disposed at two adjacent sides of the electronic apparatus 1*b* (e.g. the upper side and left side at the upper left corner), while the switching element 123*b* is located at the lower side of the radiation path 122*b*.

Figure 2C:
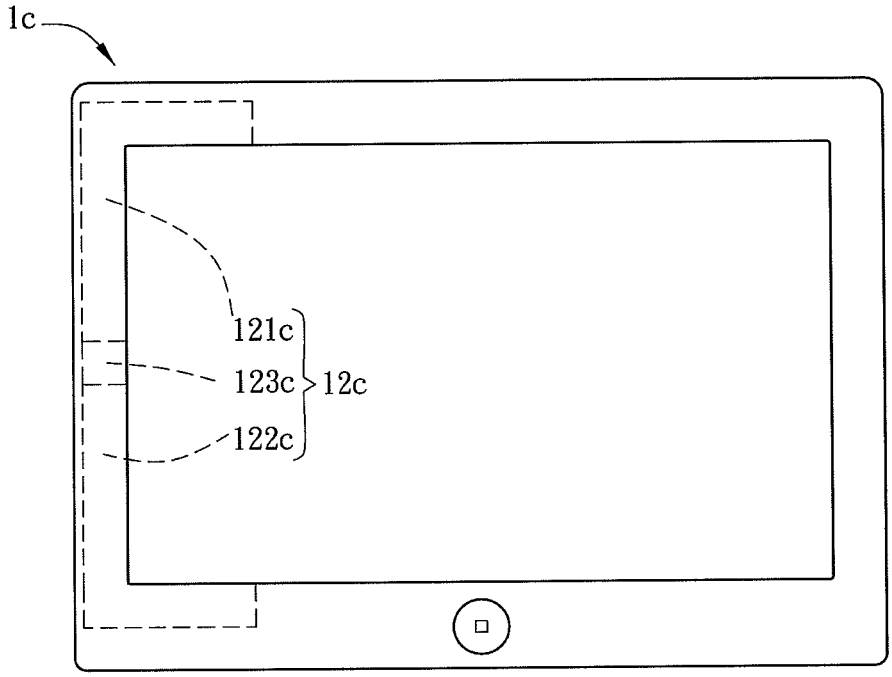

Referring to FIG. 2C, parts of the radiation paths 121*c* and 122*c* of the antenna body 12*c* are disposed at two opposite sides (upper and lower sides) of the electronic apparatus 1*c*, and the residual parts thereof are disposed at the same side (left side) of the electronic apparatus 1*c*, while the switching element 123*c* is located between the radiation paths 121*c* and 122*c*.

Figure 2D:
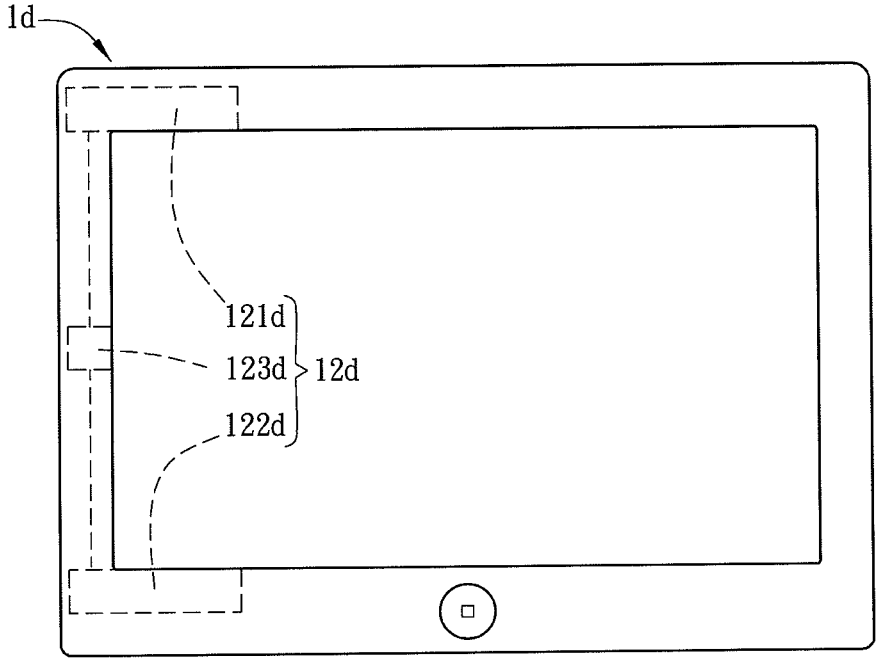

Referring to FIG. 2D, the radiation paths 121*d* and 122*d* of the antenna body 12*d* are disposed at two opposite sides (upper and lower sides) of the electronic apparatus 1*d*, while the switching element 123*c* is located at the left side of the electronic apparatus 1*d* and is electrically connected with the radiation paths 121*d* and 122*d* via wires.

The other features of the electronic apparatuses 1*a* to 1*d* can be referred to those of the electronic apparatus 1, so the detailed descriptions thereof will be omitted.

Figure 3A:
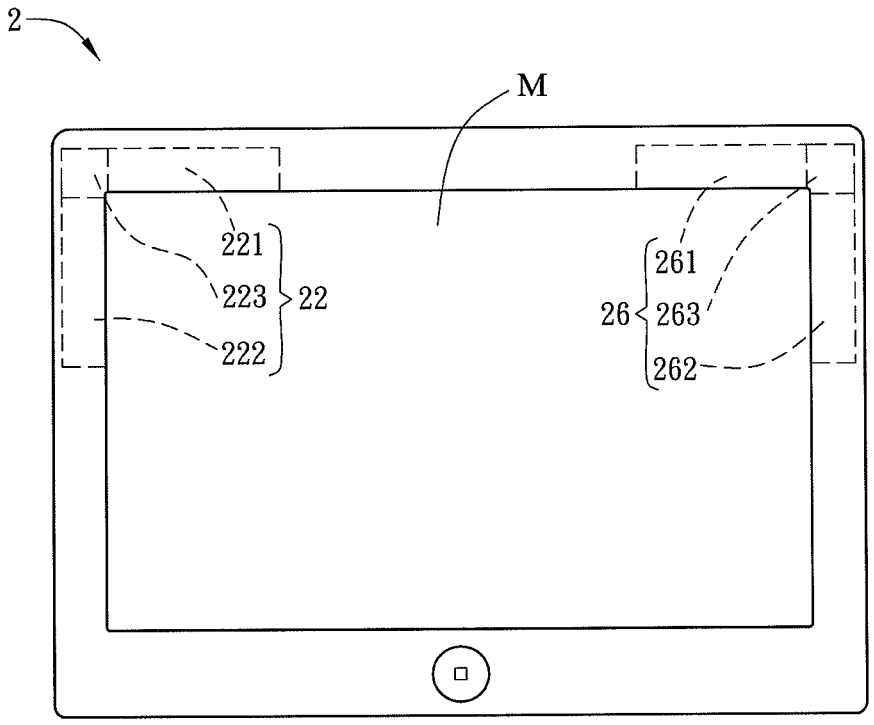
FIGS. 3A to 3C are top views of another electronic apparatus according to the preferred embodiment of the present invention.
Figure 3B:
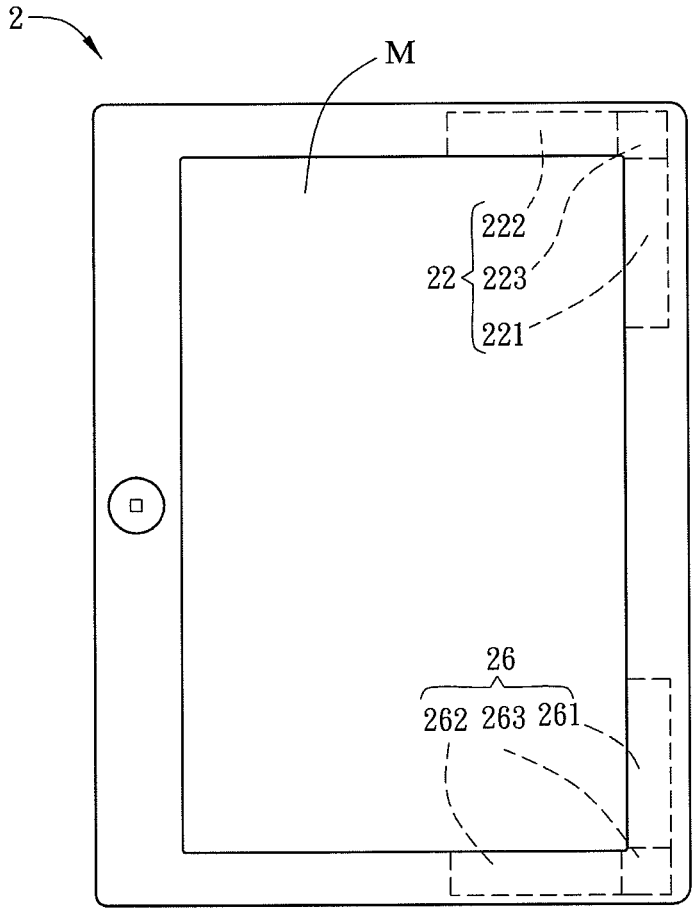
Figure 3C:
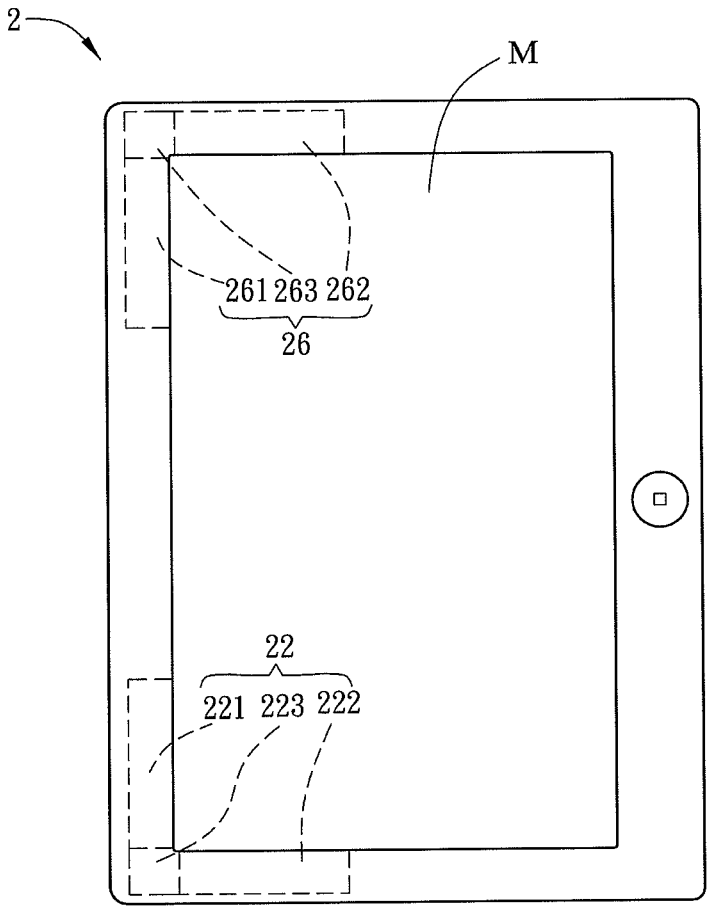

FIGS. 3A to 3C are top views of another electronic apparatus 2 according to the preferred embodiment of the present invention. In this embodiment, two antenna bodies 22 and 26 are configured at the left and right sides of the electronic apparatus 2.

As shown in FIG. 3A, the electronic apparatus 2 is in sideways (landscape mode), and the user is located at the lower side of the electronic apparatus 2. As shown in FIG. 3B, if the electronic apparatus 2 is rotated clockwise for 90 degrees, it is in vertical (portrait mode). Consequently, the radiation path 262 is now located between the user and the display portion M. Thus, the control unit controls the switching element 263 to electrically connect the feeding point to the radiation path 261. Then, the signals of the transmission unit (not shown) are now transmitted through the radiation path 261 (or through the radiation paths 221 and 222).

As shown in FIG. 3C, if the electronic apparatus 2 of FIG. 3A is rotated counterclockwise for 90 degrees, it is also in vertical (portrait mode). Consequently, the radiation path 222 is now located between the user and the display portion M. Thus, the control unit controls the switching element 223 to electrically connect the feeding point to the radiation path 221. Then, the signals of the transmission unit are now transmitted through the radiation path 221 (or through the radiation paths 261 and 262).

The other features of the electronic apparatus 2 can be referred to those of the electronic apparatus 1, so the detailed description thereof will be omitted.

Figure 4:
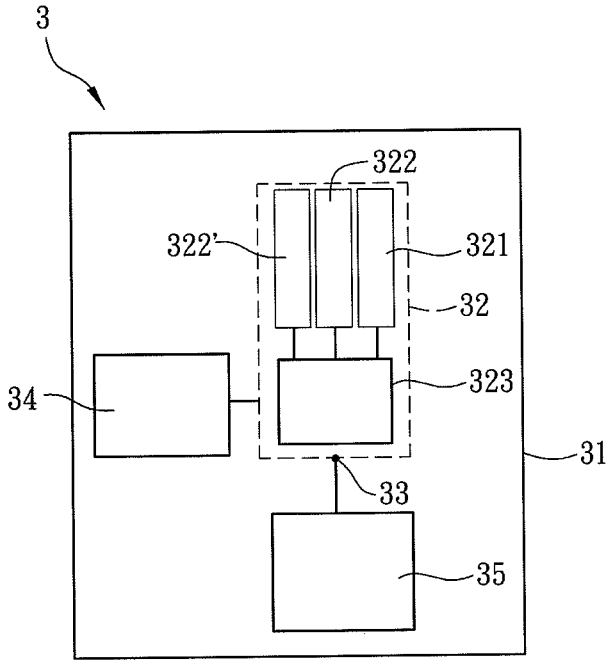
FIG. 4 is a block diagram of another electronic apparatus according to the preferred embodiment of the present invention.

FIG. 4 is a block diagram of another electronic apparatus 3 according to the preferred embodiment of the present invention.

With reference to FIG. 4, the electronic apparatus 3 includes a casing 31, at least an antenna body 32, a feeding point 33, and a control unit 34. The casing 31 has a display portion. The antenna body 32 is disposed at the casing 31 and at least has two radiation paths and a switching element 323. In this case, the antenna body 32 has three radiation paths 321, 322 and 322' for example.

parts of the radiation paths 321, 322 and 322' are respectively disposed at sides of the display portion, and the switching element 323 is electrically connected with the radiation paths 321, 322 and 322'.

The feeding point 33 is electrically connected with the switching element 323 and operationally connected to one of the radiation paths 321, 322 and 322' or their combinations.

The control unit 34 controls the switching element 323 based on the rotation of the electronic apparatus 3. When one of the radiation paths 321, 322 and 322' is located between a user and the display portion, the control unit 34 controls to selectively switch the switching element 323 for connecting another radiation path to the feeding point 33.

In addition, the electronic apparatus 3 further includes a transmission unit 35. The signal outputted by the transmission unit 35 can be inputted to the switching element 323 through the feeding point 33 and connected to one of the radiation paths 321, 322 and 322' or their combinations through the switching element 323. Accordingly, the transmission unit 35 of the electronic apparatus 3 can emit electromagnetic waves through one of the radiation paths 321, 322 and 322' or their combinations.

The other features of the electronic apparatus 3 can be referred to those of the electronic apparatus 1, so the detailed description thereof will be omitted.

In summary, parts of the radiation paths in the electronic apparatus of the embodiment are respectively disposed at sides of the display portion respectively, while the switching element is electrically connected to these radiation paths. In addition, the control unit can control the switching element based on the rotation of the electronic apparatus, so that when one of the radiation paths is located between the user and the display portion, the control unit controls to selectively switch the switching element for connecting the other radiation path to the feeding point. Accordingly, the rotation of the electronic apparatus drives the control unit to generate the control signal for controlling the switching unit, so that the feeding point of the signal can be selectively switched to connect with the other radiation path. In brief, the rotation of the electronic apparatus can control the switching unit, so that when the active radiation path is positioned between the display portion and the human body, the electronic apparatus can still emit the electromagnetic waves through the other radiation path. Compared with the prior art, the present invention can prevent the communication interruption caused by the reduced emission power while the electronic apparatus is rotated and can avoid the problem of prohibiting the user to rotate the screen.

Although the present invention has been described in considerable detail with reference to certain preferred embodiments thereof, the disclosure is not for limiting the scope. Persons having ordinary skill in the art may make various modifications and changes without departing from the scope. Therefore, the scope of the appended claims should not be limited to the description of the preferred embodiments described above.

What is claimed is:

1. An electronic apparatus, comprising:

a casing having a display portion;

at least an antenna body disposed at the casing and at least having two radiation paths and a switching element, wherein parts of the radiation paths are respectively disposed at two sides of the display portion, and the switching element is electrically connected with the radiation paths;

a feeding point electrically connected with the switching element for operationally connect to one of the radiation paths; and a control unit controlling the switching element based on a rotation of the electronic apparatus, wherein when one of the radiation paths is located between a user and the display portion, the control unit controls to selectively switch the switching element for connecting the other one of the radiation paths to the feeding point.

2. The electronic apparatus of claim 1, wherein the radiation paths are disposed at two adjacent sides or two opposite sides of the electronic apparatus respectively.

3. The electronic apparatus of claim 1, further comprising an orientation sensor for sensing the rotation of the electronic apparatus and outputting a control signal to the control unit for controlling the switch element.

4. The electronic apparatus of claim 1, wherein the electronic apparatus performs communication through WWAN (Wireless Wide Area Network), LTE (Long Term Evolution), or WIMAX (Worldwide Interoperability for Microwave Access).

5. The electronic apparatus of claim 1, wherein when the electronic apparatus comprises two antenna bodies, the antenna bodies are disposed at a left side and a right side of the electronic apparatus respectively.

6. The electronic apparatus of claim 1, wherein the electronic apparatus is a touch-control mobile phone, a touch-control computer, or a GPS.

* * * * *